United States Patent [19]

Buske et al.

[11] 4,352,282

[45] Oct. 5, 1982

[54] SHEET METAL PANEL BRAKE

[75] Inventors: Ervin Buske, Gowrie; Gerd Buske, Onawa, both of Iowa

[73] Assignee: Buske Industries, Inc., Gowrie, Iowa

[21] Appl. No.: 226,945

[22] Filed: Jan. 21, 1981

[51] Int. Cl.[3] ..... B21D 5/04

[52] U.S. Cl. ..... 72/321; 72/322; 72/317; 72/305

[58] Field of Search ..... 72/316, 317, 319–323, 72/305, 306, 384

[56] References Cited

U.S. PATENT DOCUMENTS

| | | | |
|---|---|---|---|
| 134,376 | 12/1872 | Gorton | 72/321 |
| 233,751 | 10/1880 | Haworth | 72/322 |
| 308,856 | 12/1884 | Rusland | 72/321 |
| 466,733 | 1/1892 | Bradburn | 72/321 |
| 2,147,432 | 2/1939 | Frick | 72/319 |
| 2,181,566 | 11/1939 | Jensen | 72/319 |
| 2,478,854 | 8/1949 | Webb | 72/319 |
| 2,494,149 | 1/1950 | Webb | 72/319 |
| 3,301,034 | 1/1967 | Boettcher | 72/321 |
| 3,913,370 | 10/1975 | Break | 72/319 |
| 4,173,137 | 11/1979 | Metje | 72/320 |

FOREIGN PATENT DOCUMENTS

| | | | |
|---|---|---|---|
| 8238 | of 1885 | United Kingdom | 72/320 |

*Primary Examiner*—Daniel C. Crane

*Attorney, Agent, or Firm*—Littlepage & Webner

[57] ABSTRACT

A panel brake has an intermediate jaw disposed between one fixed jaw having a straight edge and another fixed jaw having a curved edge. The intermediate jaw is movable so as to grip a panel against either the straight edge fixed jaw or the curved edge fixed jaw.

5 Claims, 10 Drawing Figures

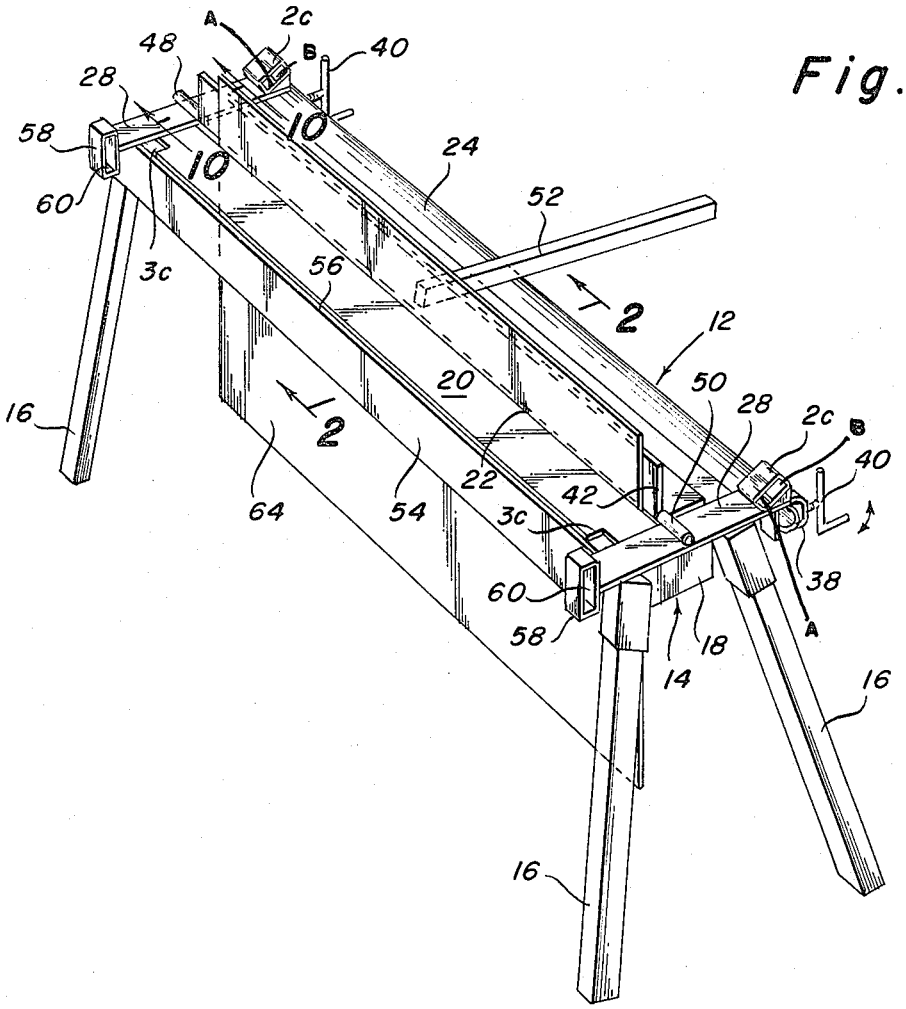
Fig. 1
Fig. 2
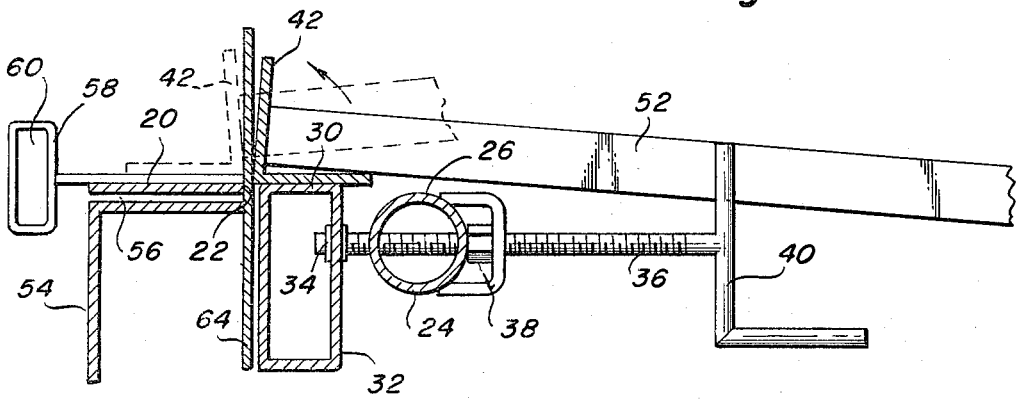

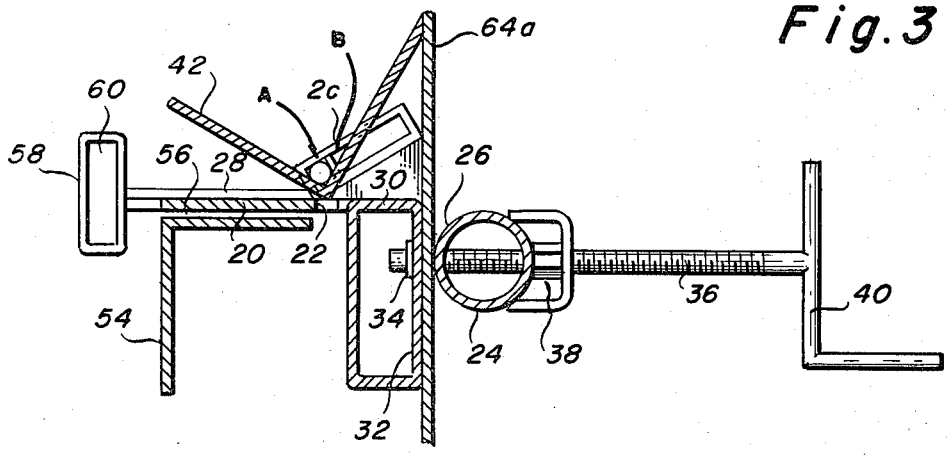
Fig. 3
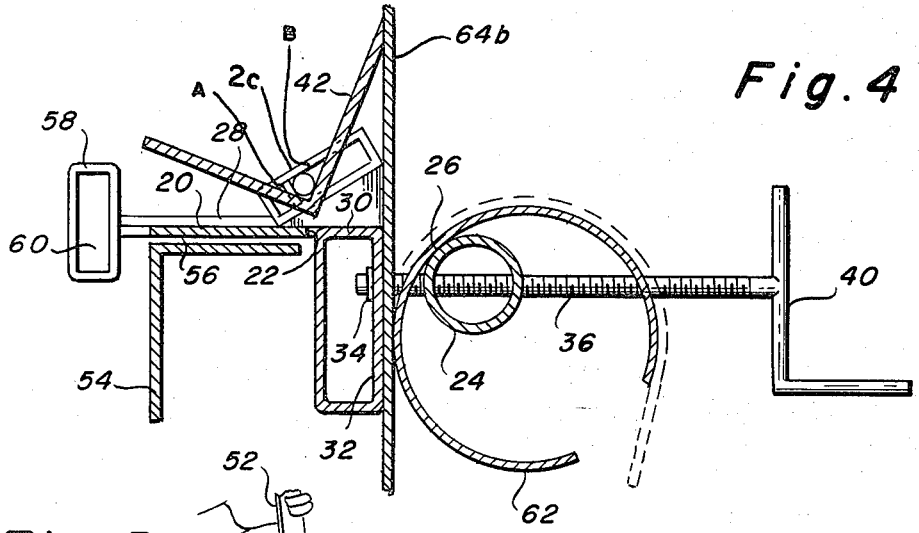
Fig. 4
Fig. 5
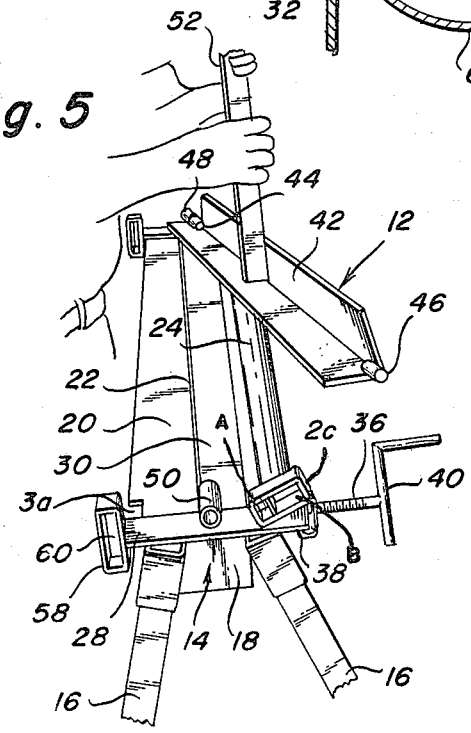
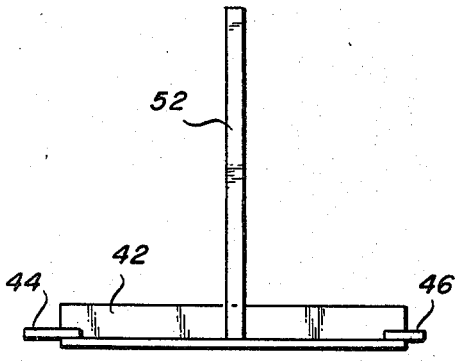
Fig. 6

SHEET METAL PANEL BRAKE

FIELD OF INVENTION

Metal deforming, with pivotal tool.

PRIOR ART

U.S. Patents:
J. Gorton, U.S. Pat. No. 134,376
A. M. Rusland, U.S. Pat. No. 308,856
R. E. Bradburn, U.S. Pat. No. 466,733
C. A. Frick, U.S. Pat. No. 2,147,432
J. Jensen, U.S. Pat. No. 2,181,566
R. L. Webb, U.S. Pat. No. 2,478,854
R. L. Webb, U.S. Pat. No. 2,494,149
G. H. Peterson, U.S. Pat. No. 2,767,762
D. G. Break, U.S. Pat. No. 3,913,370

OBJECTS

The primary object of this invention is to provide a panel brake for bending and shaping sheet metal panels such as the bends and contours on automobile and truck bodies, particularly for replacing rusted-out or severely damaged areas. To do this it is intended that the tool be extremely simple, light and sturdy, such as to enable the craftsman to move the tool to job sites. While panel brakes previously have been devised for making straight angle bends and curved bends of tight radii or large contours, a particular object now is to provide these capabilities in a single tool which can be shifted from mode-to-mode of operation quickly and easily without requiring extensive set-up for the selected mode.

These and other objects will be apparent from the following specifications and drawings in which:

FIG. 1 is a perspective view of the panel brake;

FIG. 2 is a diagrammatic cross section along the line 2—2 of FIG. 1 showing a panel clamped against the straight-edge jaw, with parts removed for simplification;

FIG. 3 is a view similar to FIG. 2, but showing in full lines a panel clamped against the curved edge jaw with bending about to commence;

FIG. 4 is view similar to FIG. 3 showing in full lines a panel clamped against a large radius form with bending of the panel about to commence and showing in broken lines the panel having been bent to a curvature of large radius;

FIG. 5 is a perspective view from an end illustrating the mounting of the braker bar;

FIG. 6 is a front elevation of the braker bar;

Figure 7:
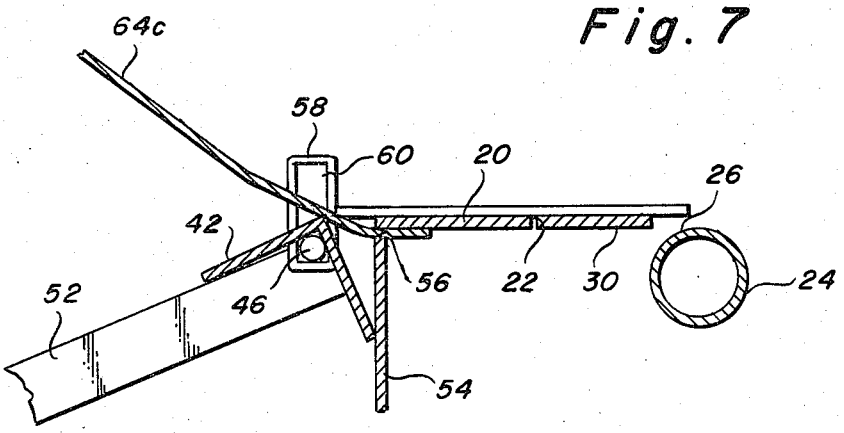
FIG. 7 is a fragmentary cross section illustrating the commencement of a 180° bend in the panel; and, FIG. 8 is a view similar to FIG. 7 illustrating further progress of 180° bend in the panel.

Referring now to the drawings in which like reference numerals denote similar elements, the sheet metal panel brake 12 includes a frame denoted generally at 14, having legs 16 at each end connected by a cross bar 18. Extending between the end cross bars 18 is a fixed jaw 20, having a straight working edge 22, and spaced forwardly from fixed jaw 20 is another fixed jaw 24—hereinafter referred to as a radius bar—which has an arcuate edge 26 of tight radius. Rigidly affixed over fixed jaw 20 and radius bar 24 at each end is a cap plate 28, which is spaced above cross bar 18 at each end providing slots (not shown) in which slide the ends of a movable jaw 30. On the side 32 of movable jaw 30 are collars 34 which hold captive the ends of screws 36, and nuts 38 are mounted on radius bar 24. Screws 36 are manually operated by means of cranks 40 so that rotation of the screws moves jaw 30 back and forth between fixed jaw 20 and radius bar 24.

Figure 10:
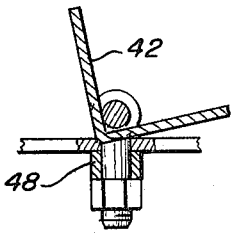

Normally mounted above and spaced slightly forwardly from the straight edge 22 of fixed jaw 20 is a braker bar 42 of conventional L-shape, having at one end a long pintle 44 and at the opposite end a short pintle 46. The longer pintle 44 rotatably engages in a swivel trunnion 48 (FIG. 10) and the shorter pintle 46 engages in a fixed trunnion 50 at the opposite end of the frame so that the breaker bar may be mounted or removed as illustrated in FIG. 5. The breaker bar is provided with the usual lever 52.

In addition to trunnions 48 and 50, frames **2*c* each provided with a short portion A and a long B are affixed on cap plates 28**. Their functions will be detailed hereinafter.

At the rear of fixed jaw 20 is a depending flange 54 whose upper edge is spaced from the fixed jaw to define therebetween a slot 56 into which a panel may be inserted (FIG. 7–9) and on each rear end of cap plates 28 is open frame 58, defining a vertically elongate slot 60. The function of these elements at the rear of the unit will be described hereinafter. As shown in FIG. 4, a large radius form 62 may be fitted over radius bar 24 for imparting bends of relatively large radius to a sheet.

In operation, and assuming that the right-angle bend is to be made in a flat panel 64, the movable jaw 30 is first backed away from fixed jaw 20, the panel 64 is inserted therebetween, movable jaw 30 is advanced to grip the panel between it and the fixed jaw and the braker bar handle 52, positioned as in FIG. 1 and FIG. 2, is raised so as to impart a right-angle bend in the panel. Referring now to FIG. 3, if a bend of short radius is to be made in a panel **64*a*, for example, the movable jaw 30 is first advanced away from radius bar 24, the panel 64*a* is inserted in the space between the rear edge of the movable jaw 30 and the radius bar 24. The movable jaw is then backed by turning the crank 40 so as to engage the panel between the rear edge of the movable jaw and the radius bar, and then the panel is manually swung forwardly and downwardly, as shown in broken lines, to form the bend of short radius in the panel. If a bend of relatively large radius is to be formed in the panel, semi-cylindrical form 62 is placed over the radius bar 24 (FIG. 4) and the panel 64*b* is engaged between the form and the forward edge of the fixed jaw 30** and manual bending ensues as previously described.

When it is desired to use the braker bar to bend a panel partly over radius bar 24, the pintles 44, 46 of the braker bar are inserted in the short portions A of frames **2*c*. If it is desired to use the braker bar for forcing a panel partly over form 62, the pintles are inserted in the long portion B of frame 2*c*** and this provides a sliding pivot which permits the braker bar to follow the bend partly around the form.

Figure 8:
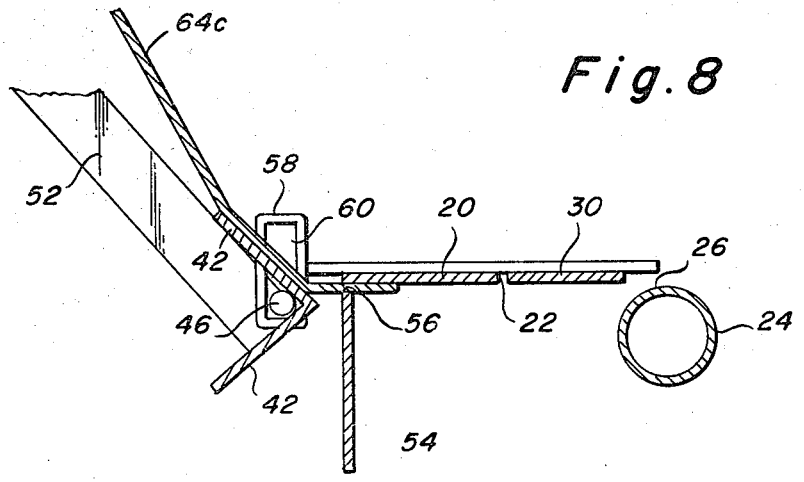
Figure 9:
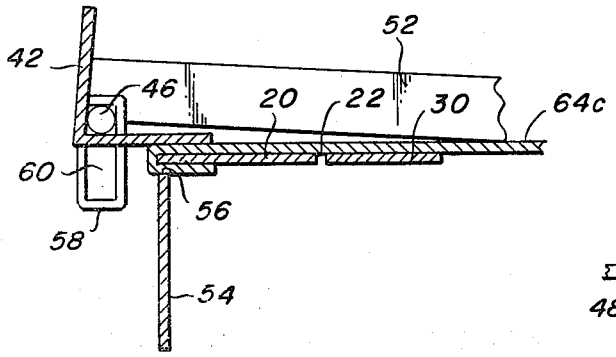
FIG. 9 is a view similar to FIG. 8 showing completion of a 180° bend in the panel; and, FIG. 10 is a fragmentary cross section along the line 10—10 of FIG. 1 showing the swivel hinge and the mounting of the braker bar therein.

Refering now to FIG. 7, FIG. 8, and FIG. 9, if a 180° bend is to be made, the braker bar 42 is removed from its FIG. 1 position and its pintles 44 and 46 are engaged in the elongate slots 60 defined by the frames 58 at the rear of the machine. Thereafter, the edge of a panel 64c is engaged through slot 56 which is exposed between the depending flange 54 and the fixed jaw 20, and then by swinging the braker bar upwardly (FIG. 8) the bend is commenced; and by swinging the braker bar completely forward, the panels 44 46 rise in slots 60 to permit the full-forward swinging of the braker bar to impart the 360° bend in the panel.

Notches 3c are provided at each rear end of fixed jaw 20 to accomodate previously bent flanges along the edge of the bend.

We claim:

1. A sheet metal panel brake, comprising:

a frame having laterally spaced opposite ends and front and rear sides, a first jaw fixed to the frame and extending from end to end on said frame, said first fixed jaw having a straight edge disposed toward the front side of the frame, a second jaw fixed to the frame and extending from end to end on said frame and spaced toward the front side of the frame from the first fixed jaw, said second fixed jaw having a curved edge spaced from and disposed toward the straight edge of the first fixed jaw, a movable jaw extending from end to end of said frame and disposed between said edges of the fixed jaws and means for mounting said movable jaw on said frame for forward and rearward reciprocating movement between the fixed jaws said movable jaw having clamping surfaces on opposite sides thereof, and means for reciprocating said movable jaw forwardly and rearwardly for selectively holding a sheet against either the straight edge of the first fixed jaw or the curved edge of the second fixed jaw by engaging a respective clamping surface against said straight edge or said curved edge, a braker bar, and means for pivotally mounting opposite ends of said braker bar on respectively opposite ends of said frame so that said braker bar can bend a sheet against either the straight edge of the first fixed jaw or the curved edge of the second fixed jaw.

2. A sheet metal brake as claimed in claim 1, the means of pivotally mounting opposite ends of said braker bar on opposite ends of said frame comprising trunnions on opposite ends of said frame, and pintles on opposite ends of said braker bar rotatably engaging in said trunnions.

3. A sheet metal brake as claimed in claim 2, means providing adjacent that side of the first fixed jaw which is disposed toward the rear of said frame a rearwardly-open slot for receiving an edge portion of said panel, and means on opposite ends of said frame and adjacent the rear side thereof providing vertically elongate slots for slidably and rotatably mounting the pintles on the opposite ends of the braker bar.

4. A sheet metal brake as claimed in claim 1, the curved edge on said second fixed jaw being on an arc of a circle having a relatively small radius, and a sheet metal form engagable substantially around the second fixed jaw, said form having an outer surface disposed along an arc of a circle having a radius substantially greater than the radius of the first circle.

5. A sheet metal brake as claimed in claim 4, the means for pivotally mounting opposite ends of said brake bar including sliding pivot means for permitting the brake bar to follow a bend of a hand at least partly around said form.

* * * * *